US005657566A

United States Patent [19]

Key

[11] Patent Number: 5,657,566

[45] Date of Patent: Aug. 19, 1997

[54] RAPID MOUNT ADVERTISING PANELS

[76] Inventor: Jeffrey M. Key, 1019 N. Yale, Fullerton, Calif. 92631

[21] Appl. No.: 508,438

[22] Filed: Jul. 28, 1995

[51] Int. Cl.[6] ..... G09F 7/08

[52] U.S. Cl. ..... 40/590; 40/591; 40/611; 40/618

[58] Field of Search ..... 40/589, 596, 591, 40/611, 618, 620, 489

[56] References Cited

U.S. PATENT DOCUMENTS

| | | | |
|---|---|---|---|
| 4,035,940 | 7/1977 | Mickey et al. | 40/140 |
| 4,275,516 | 6/1981 | Lane | 40/618 X |
| 4,628,624 | 12/1986 | Gunn | 40/591 |
| 4,756,107 | 7/1988 | Hillstrom | 40/603 |
| 5,058,299 | 10/1991 | Suzuki | 40/603 |
| 5,083,826 | 1/1992 | McCrary | 296/21 |
| 5,239,765 | 8/1993 | Opdahl | 40/603 |
| 5,357,701 | 10/1994 | Grate | 40/618 |

*Primary Examiner*—Kenneth J. Dorner
*Assistant Examiner*—Cassandra Davis
*Attorney, Agent, or Firm*—Cleveland R. Williams

[57] ABSTRACT

Rapid mount advertising panels for motor vehicles, such as trucks, are disclosed comprising a plurality of panels which are removably attached to the side of a trailer in such a manner, that as a group they form a large bill board surface. The display panels are constructed and designed to resist sagging and distortion of said panels due to the effect of heat, wind, etc. when the truck is moving.

20 Claims, 4 Drawing Sheets

RAPID MOUNT ADVERTISING PANELS

BACKGROUND OF THE INVENTION

1. Field of the Invention

This invention relates to rapid mount advertising panels that are suitable for rigidly but temporarily attaching to the side of a trailer truck or similar support unit. The system comprises a plurality of individual sign panels containing billboard art which form a desired image or message when assembled on the trailer or similar support unit.

Currently, many long haul vehicles used to transport cargo or other freight consist of a tractor cab and a trailer having a large cargo area. These trailers have enclosures containing very large vertical walls for containing and protecting cargo and freight contained therein. The vertical side walls of a trailer present an expanse of advertising surface that is largely under-utilized in today's marketplace. One problem associated with advertising on the side of trailers consists of either a permanent art display or a display that is not easy to change. The current invention solves this problem by providing for an advertising system that is readily and easily removed and attached to the side of a trailer or similar support unit.

2. Description of the Prior Art

Numerous display signs and poster display devices have been utilized in the past for displaying various messages and images to the public for information and advertising purposes. Some of these devices have been attached to trucks and similar vehicles.

For example, U.S. Pat. No. 4,035,940 to Mickey et al relates to a segmented sign board which provides means for gripping the opposite edges of sign letters to hold them securely on the face of the sign board.

The gripping means consists of a core block containing U-shaped channel members extending along the upper and lower edges of said core block, wherein the U-shaped channel members contain longitudinally extending grooves to receive the upper and lower portions of letters inserted into said grooves.

U.S. Pat. No. 4,628,624 to Gunn discloses a vehicle door-mounted sign holder which is removably attached to said vehicle. Particularly, the sign holder contains upper and lower support members with pockets in said support members to hold the edges of a sign. Extendable arms telescoping from each end of the support members contain curved ends for engaging the inside surface of a door edge. Each arm is fastened to the inside surface of the door edge with a set screw. The surfaces of each arm facing the door are covered with a soft material and rubber nuts are attached to the inside surface of the support members to protect the door's finish.

U.S. Pat. No. 4,756,107 to Hillstrom describes a display retention and tensioning frame for holding and displaying a sign or poster on the side of a vehicle, for example, a truck trailer. The device contains a plurality of elongated frame sections, each section having a base member and a hinged cover member. One or more slide members is mounted inside the base member of the frame section. A retainer member is pivotally interconnected with a portion of the slide member with movement means into and out of interlocking engagement with a peg or post to securely retain a poster or sign in place during installation.

U.S. Pat. No. 5,058,299 to Suzuki relates to a flexible sheet-like member for receiving an advertising bill which consists of a flexible flat sheet support member, a first fastening member arranged on the flat support sheet member; and a second fastening member attached to the bill in order to secure the bill to the flat support sheet member in cooperation with the first fastening member.

U.S. Pat. No. 5,083,826 to McCrary discloses a mobile promotional vehicle which contains an informational display superstructure having a pair of opposed, upwardly extending slide walls, each having an outwardly facing display surface. The display superstructure extends upwardly from the tractor truck bed, the walls of which converge as they progress from the rear of the bed toward the cab of the vehicle.

U.S. Pat. No. 5,239,765 to Opdahl describes a low-profile, light-weight advertising display for exhibiting advertisements on the sides of trucks, billboards, etc. The advertising display has a tensioned display panel. The elastic display panel can be rolled up for transport. A plurality of stays are mounted on the display panel wherein said stays are inserted anchor by anchor within said anchors until the edges of the display panel are suspended between a framework of anchors.

As can readily be determined from the foregoing there is an ongoing research effort and a need to develop and produce new and novel rapid mount advertising devices for trucks and similar motor vehicles.

SUMMARY OF THE INVENTION

The present invention resides in rapid mount advertising panels for motor vehicles that comprise a plurality of panels, each of said panels containing a central retaining plate and cavity located on the back side of each of said panels; one or more bottom retaining plates and cavities located on the front and near the bottom of each of said panels; air foil means attached to the front and rear respectively of the first and last panels; upper bracket means for receiving and securing the top portion of each of said panels; central bracket means for engaging and securing the center portion of each of said panels; lower bracket means for receiving and securing the lower portion of each of said panels; and latching and locking means for latching and locking the bottom portion of each of said panels.

BRIEF DESCRIPTION OF THE DRAWINGS

The invention is further described by reference to the appended drawings taken in conjunction with the following description where.

DETAILED DESCRIPTION OF THE INVENTION

Figure 3:
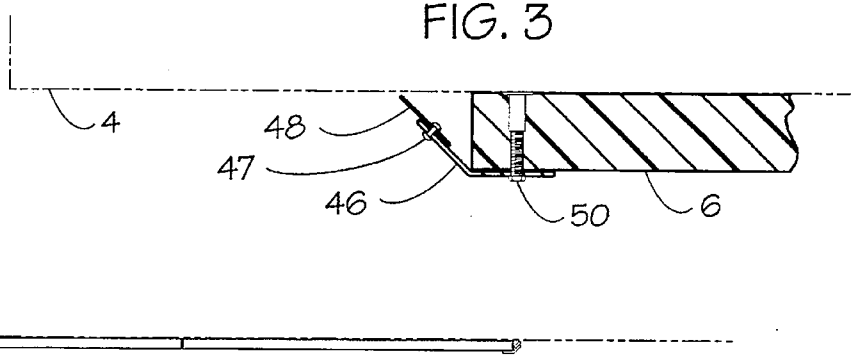
FIG. 3 is a close-up, cut-away view of FIG. 2 which discloses in greater detail the front air foil.

This invention resides in rapid mount advertising panels comprising a plurality of individual sign panels that are rigidly but removably attached to a flat surface.

In a preferred embodiment of the invention the rapid mount advertising panels are attached to the side of a truck trailer. Alternate embodiments of the invention include attaching the panels to the wall of a building, the side of railroad cars, on advertising billboards, and on the flat surface of a transportable vehicle designed for advertising purposes, which is readily pulled behind a motor vehicle.

Embodiments of the rapid mount advertising panels of the present invention are hereinafter described with reference to the drawings, in which identical or corresponding parts are indicated by the same reference characters or numbers through the several views.

Figure 1:
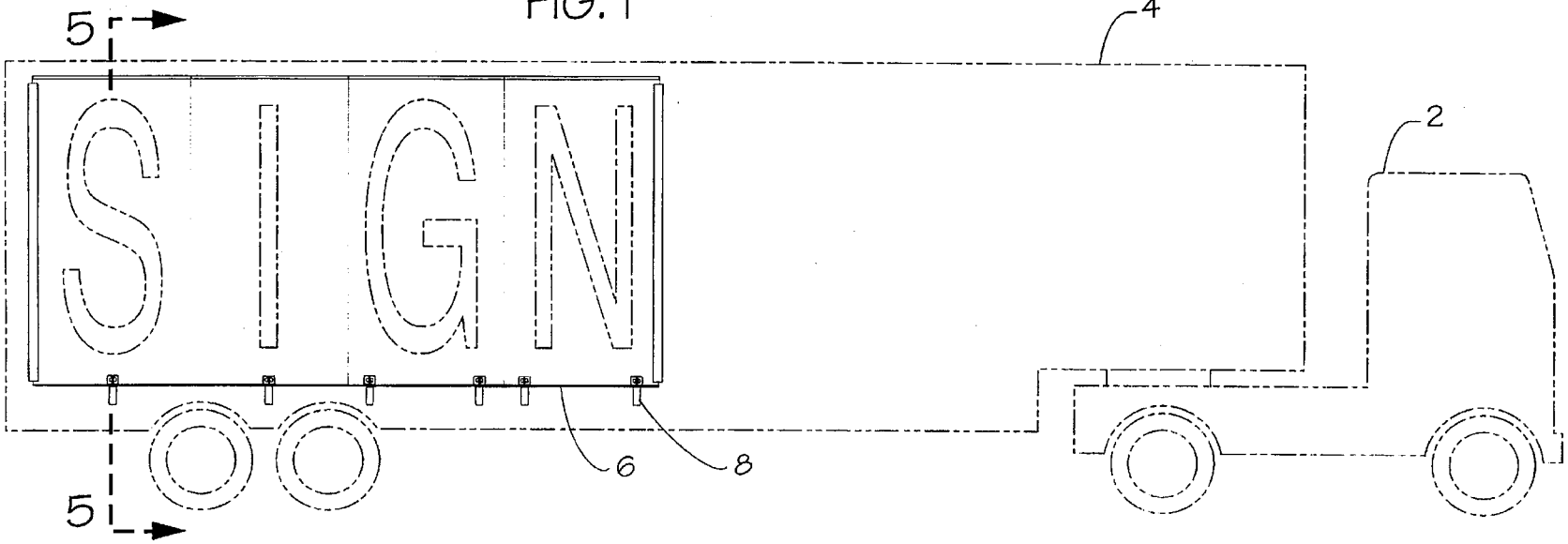
FIG. 1 is a frontal view of a trailer truck which contains a plurality of sign panels.

FIG. 1 illustrates a side view of a plurality of rapid mount advertising panels 6 attached to the side of truck trailer 4 and depicting latch means and locking means 8. Truck trailer 4 is attached to truck cab 2. Generally, rapid mount advertising panels 6 are from 2 feet to 10 feet wide and from 6 feet to 12 feet tall. The plurality of panels 6 comprise from 2 to 16 panels. Air foil 46 is attached to the front end of first panel 6 and to the back end of last panel 6. Individual panel 6 of the plurality of panels can be constructed from wood, sheet metal or plastic materials.

Figure 2:
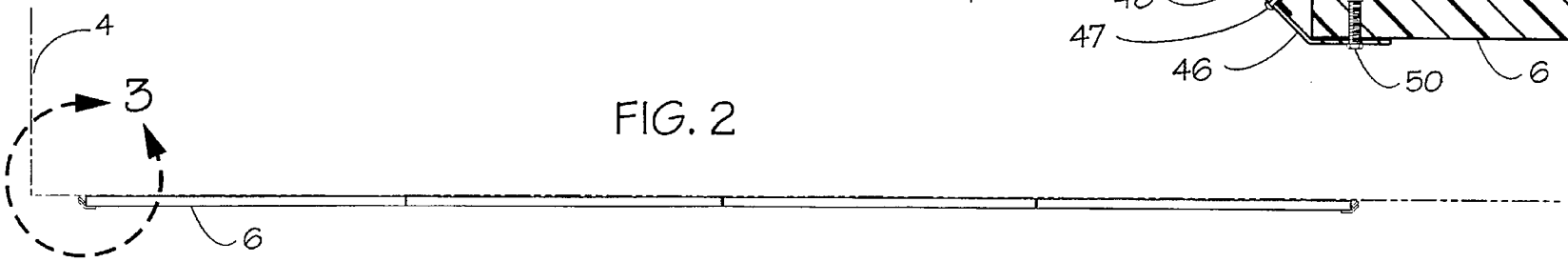
FIG. 2 is a top, cut-away view of the plurality of sign panels of FIG. 1 which depicts a front air foil attached to the first panel and a back air foil attached to the end or last sign panel.

FIG. 2 is a top, cut-away drawing of the plurality of sign panels 6 of FIG. 1 viewed along line 7 (of FIG. 1) and in conjunction with line 3, which shows air foil 46 attached to the front end of the first panel 6 of the plurality of panels of this invention. It should be noted that air foil 46 is also attached to the back end of the last panel 6 of the plurality of panels herein.

FIG. 3 is a close-up, cut-away view of FIG. 2 viewed along line 7. FIG. 3 depicts the side of truck trailer 4 to which is attached panel 6. Air foil 46, an angled substrate such as wood, plastic or metal, is attached to panel 6 by fastener 50. A pliable material 48 such as rubber, soft plastic or the like is attached to the end of air foil 46 by fastener 47. It is to be noted that the fasteners herein can be either screws, threaded bolts with threaded nuts or the like.

Figure 4:
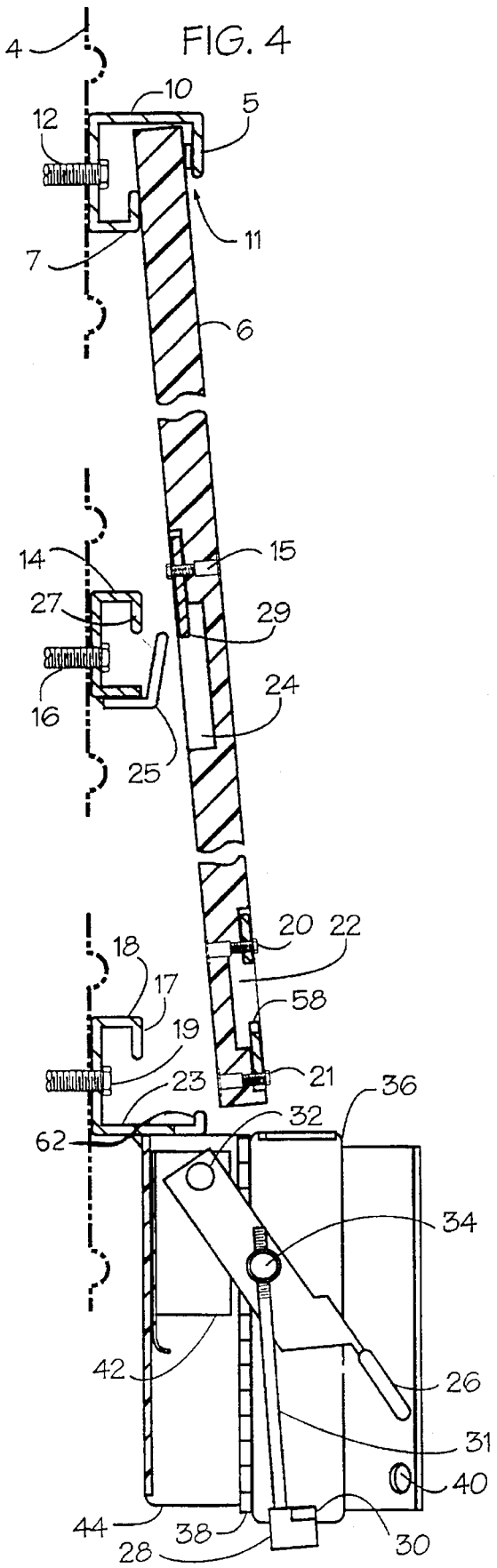
FIG. 4 is a cross-section view of one of the sign panels of FIG. 1 wherein said panel is at an angle of approximately 30 degrees from vertical to the side of a truck trailer, in a pre-installation position.
Figure 5:
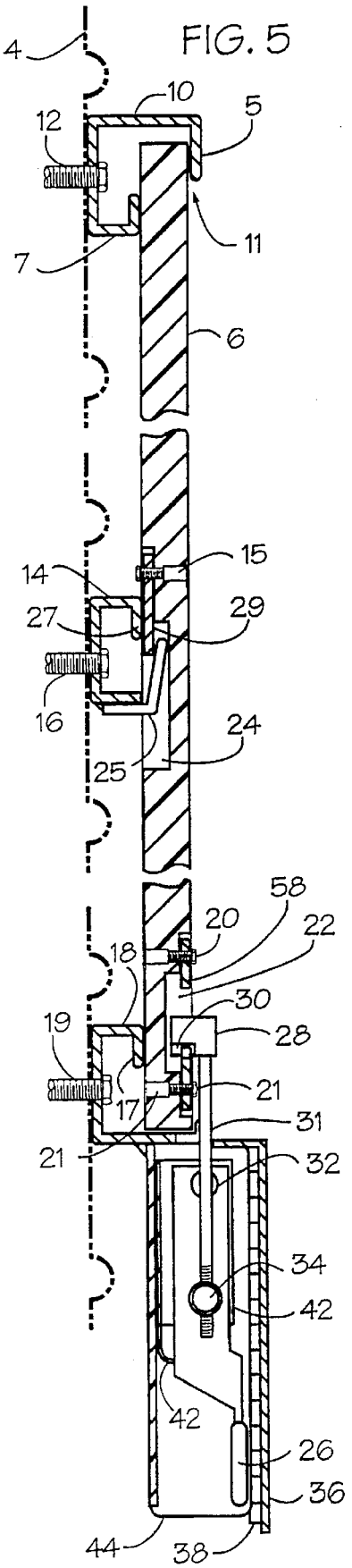
FIG. 5 is another cross section view of the sign panel depicted FIG. 4 wherein the panel has been installed in it's proper position on the side of a truck trailer along line 5—5 of FIG. 1.

FIG. 4 and FIG. 5 are front, cross-section views of one of the plurality of sign panels 6 of FIG. 1 wherein panel 6 of FIG. 4 is at an angle of approximately 30 degrees from vertical to the side wall of truck trailer 4, in a pre-installation position and panel 6 of FIG. 5 is installed in it's proper position on the side wall of truck trailer 4.

Referring now to FIGS. 4 and 5. Panel 6 contains central retaining plate 29 and cavity 24 located on the back and near the center of each of panel 6 of said; plurality of panels. Central retaining plate 29 is attached to panel 6 by fastener 15. Central retaining plate 29 comprises a downward directed overhanging lip or flange which extends from the top of cavity 24 in a downward direction.

Bottom retaining plate 58 and cavity 22 are located on the front of and near the bottom of panel 6, wherein said bottom retaining plate 58 is attached to panel 6 by fasteners 20 and 21. Bottom retaining plate 58 contains an upwardly directed overhanging lip or flange having a serrated top surface, said lip or flange extends from the bottom of said cavity in an upward direction. It is to be noted that each panel 6 in the plurality of panels herein can contain from 1 to 4 bottom retaining plates 58 and cavities 22. In a preferred embodiment, each of said panel 6 contains two (2) bottom retaining plates 58 and cavities 22.

It should additionally be noted that each of central retaining plate 29 and cavity 24 and bottom retaining plates 58 and cavities 22 can be separate units or constructed as one unit. For example, when panel 6 is constructed from wood, cavities 22 and 24 can be carved or chiseled from panel 6. When panel 6 is constructed from sheet metal or plastic, the retaining plates and cavities are constructed and form a single unit which attaches to said sheet metal or plastic with fasteners.

Upper bracket means 10 is attached to the side of truck trailer 4 by fastener 12. Upper bracket means 10 comprises an elongated, inverted G-shaped channel containing outer, downwardly directed lip or flange 5. Containing padded attachment 11 for receiving the top, front portion of panel 6. Padded attachment 11 can be constructed from pliable, foam rubber, rubber, plastic or the like. The inverted G-shaped channel also contains an inner upwardly directed lip or flange 7 for receiving the top back portion of panel 6.

Central bracket means 14 comprises an elongated C-shaped brace containing downwardly directed lip or flange 27 for bracing against central retaining plate 29 located on the back near the center of panel 6. Central bracket means 14 is attached to the side of truck trailer 4 by fastener 16.

Central bracket means 14 contains a plurality of adjusting, latching hooks 25 which have a slight angle directed outwardly from vertical. Latching hook 25 are attached to the bottom of central bracket means 14. The number of latching hooks 22 will depend upon the number of panels 6 in the plurality of panels utilized in the invention. One latching hook 22 will be needed for each individual panel 6 in the plurality of panels herein. Latching hook 25 is slidably received into cavity 24 and engages the downwardly directed lip of central retaining plate 29.

The C-shaped brace of central bracket means 14 contains lip or flange 27 which extends in a downwardly direction and braces against central retaining plate 29 of panel 6.

Lower bracket means 18 comprises an elongated inverted, G-shaped channel containing inner, downwardly directed lip or flange 17 and bottom channel member 23 containing outer, upwardly directed lip 62.

Latching and locking means 44 comprise a base plate 42 connected to the bottom of lower bracket means 18. Latching and locking means 42 can be attached to the bottom of lower bracket means 42 utilizing standard means, for example by welding, with fasteners, etc.

Latching means 44 is preferably a draw latch comprising base plate 42, lever member 26 pivotably attached to base plate 42 by metallic pin 32, latching arm means 31 pivotably attached to lever member 26 by metallic pin 34, said latching arm means containing latching head 28 and serrated surface 30; outer plate 36 is attached to base plate 42 by hinge 38. Round hole 40 is located at the lower portion of outer plate 36 and is constructed to receive locking means therein.

In FIG. 4, latching means 44 and outer plate 36 are in open position which allows latching means 44 to pivot around first metallic pin 32 and second metallic pin 34 to engage lower retaining plate 58.

In the pre-installation position, e.g. FIG. 4, panel 6 is positioned at an angle of approximately 30 degrees from vertical trailer wall 4, and guided into the top of upper bracket means 10.

In the installed position, e.g. FIG. 5, panel 6 has been moved vertical with trailer wall 4 pushing said panel 6 over the top of lower bracket means 18 and onto latching hook 25 of central bracket means 14. Panel 6 is then allowed to side down approximately 0.2 to 0.9 inches into the channel of lower bracket means 18. Latching means 44 is pivotably engaged with lower retaining plate 58 and outer plate 36 is closed to engage base plate 44, thus preventing latching means from disengaging from lower retaining plate 58.

Locking means, for example a standard lock, is inserted in hole 40 of outer plate 36 and a similar but unseen hole, as viewed in FIG. 5, in base plate 44.

Figure 6:
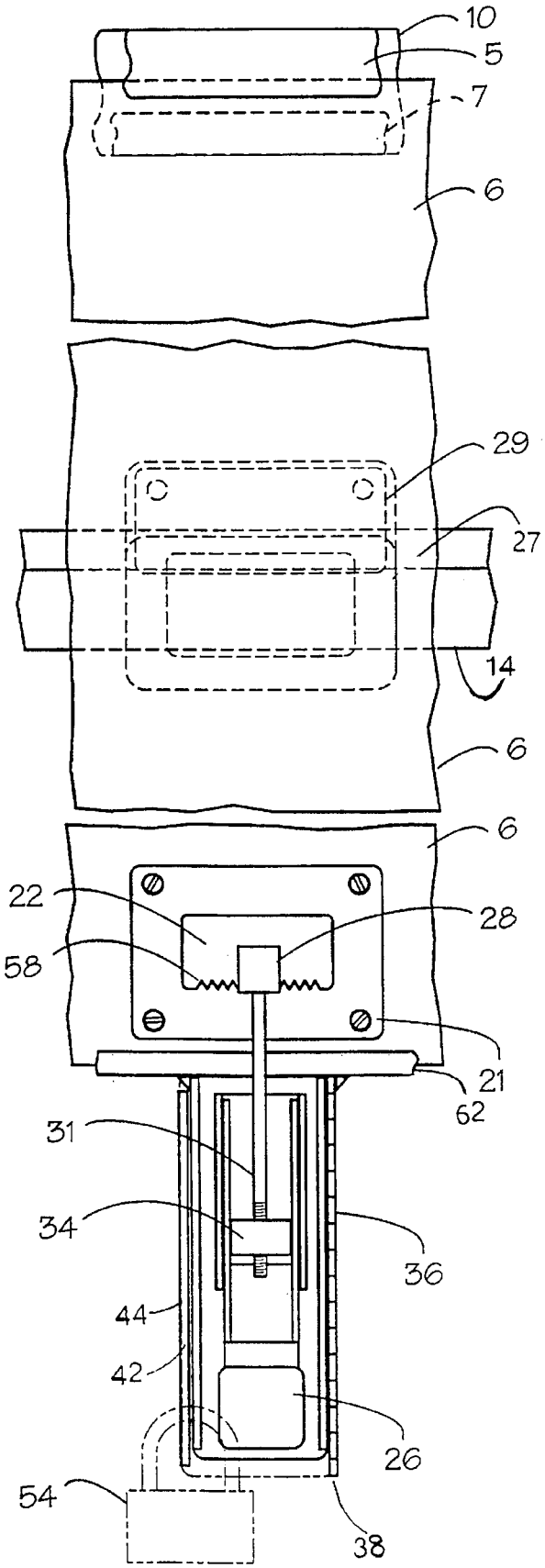
FIG. 6 is a front, cut-away view of a sign panel disclosing a top bracket, center bracket, bottom bracket and latching means of said panel.

FIG. 6 is yet another front, cut-away view of sign panel 6 disclosing upper bracket means 10, with outer, downwardly directed lip or flange 5 overlapping the top portion of panel 6 and inner, upwardly directed lip or flange 7 which acts as a brace against the back of the upper portion of panel 6.

The central portion of the cut-away view of FIG. 6 shows central retaining plate 29, central bracket means 14 and downwardly directed lip or flange 27, all superimposed on the center portion of panel 6.

The lower portion of the cut-away view discloses panel 6 containing lower retaining plate 58 with serrated surface, cavity 22, latching and locking means 44 containing a draw latch comprising base plate 42, lever member 26, outer plate 36, hinge member 38, latching arm means 31 containing latching head 28 and pivotally attached to lever means 26 by metallic pin 34. Lower, upwardly directed lip or flange 62 overlaps the lower portion of panel 6. Locking means 54, e.g. a standard lock, passes through unseen hole 40, e.g. from FIG. 4 to lock base plate 42 to outer plate 36.

Figure 7:
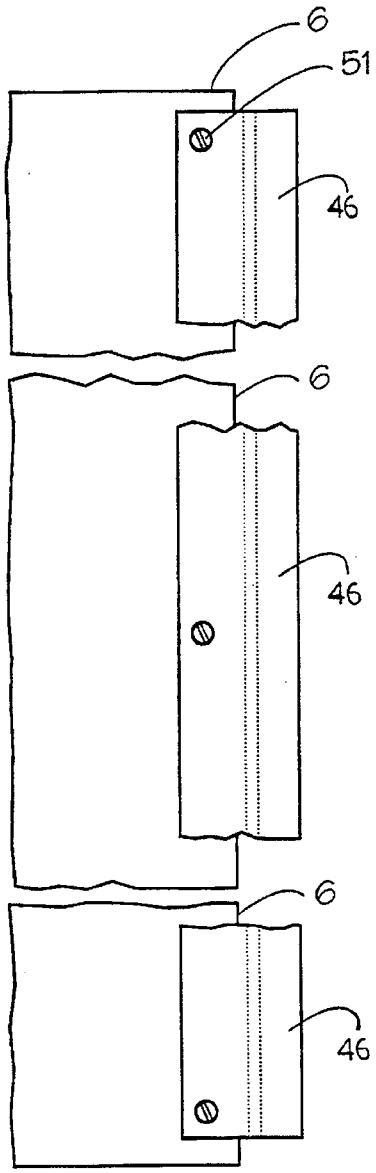
FIG. 7, is a front, cut-away view of the sign panel of FIG. 1 which shows the air foil attached to said panel.

FIG. 7 is a front cut-away view of the sign panel of FIG. 6 which shows air foil 46 attached to the front of first panel 6 in a plurality of panels by fastener 51.

Figure 8:
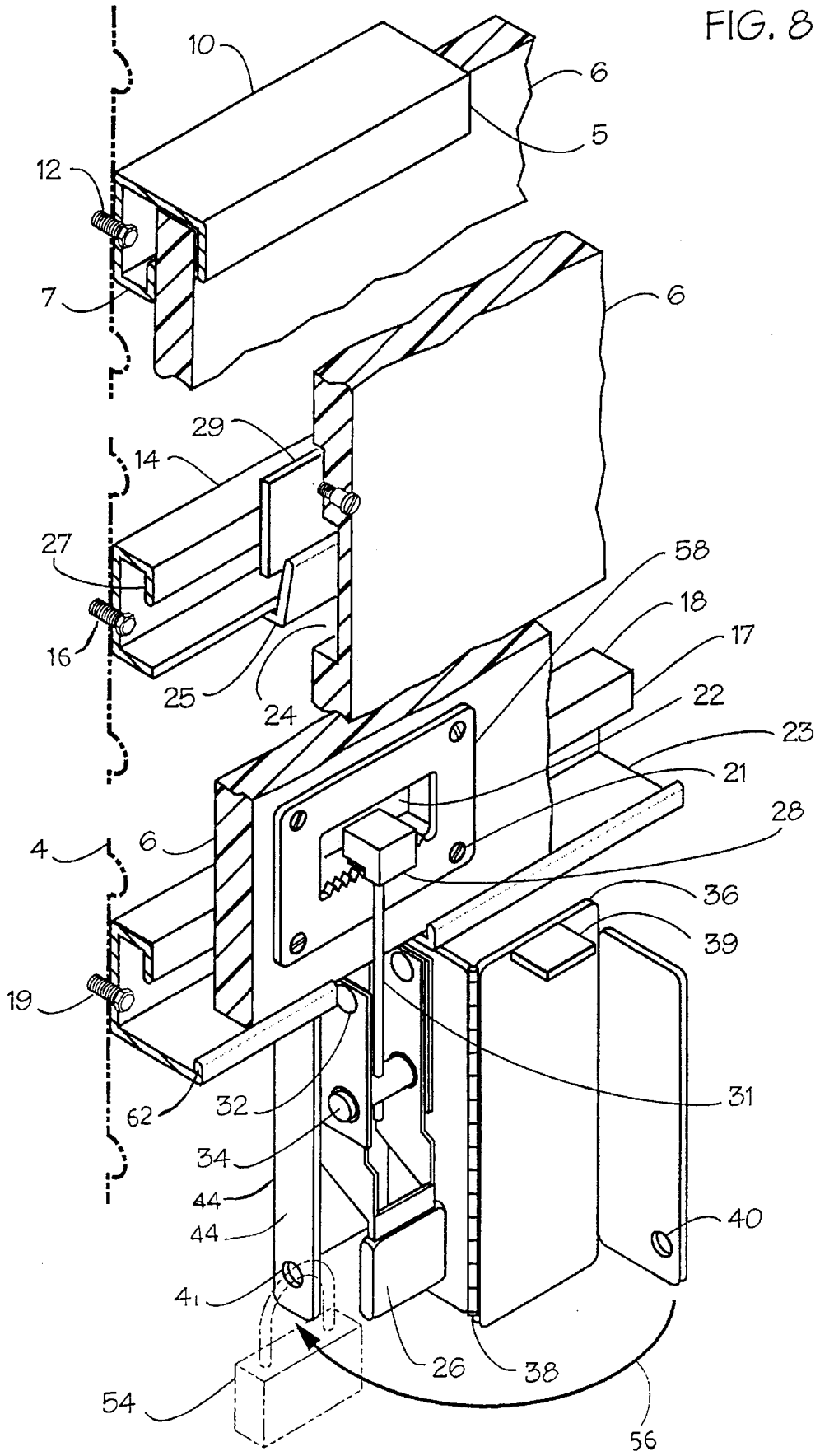
FIG. 8 is a frontal, perspective view depicting in greater detail the top bracket means, center bracket means, bottom bracket means and latching and locking means of the panels according to the invention herein.

FIG. 8 is a frontal, perspective view depicting in greater detail a preferred embodiment of the invention herein.

Upper bracket means 10 is attached to surface 4 by fastener 12. The upper portion of panel 6 is inserted between the outer, downwardly directed lip or flange 5 and the inner, upwardly directed lip or flange 7.

The center, cut-away view shows panel 6, containing central retaining bracket 29 and central cavity 24, both located on the back side of said panel. Central bracket means 14 is attached to surface 4 by fastener 16 and contains downwardly directed lip or flange which braces against the back of panel 6. Latching hook 25 is attached to the bottom of central bracket means 14 and engages the inner side of retaining plate 29 through cavity 24.

The lower, cut-away view of FIG. 8 depicts panel 6 having lower retaining plate 58, which contains a serrated surface and cavity 22. Lower retaining plate 58 is attached to panel 6 by fastener 21. Lower bracket means 18 is attached to surface 4 by fastener 19. Bottom channel member 23 receives the bottom of panel 6. Inner, downwardly directed lip or flange 17 acts as a brace against the lower, back portion of panel 6. Outer upwardly directed lip or flange 62 overlaps the outer, bottom portion of the bottom part of panel 6 and prevents it from sliding out of said bracket means.

Latching and locking means 44 is attached to the bottom of lower bracket means 18 using conventional methods. Latching and locking means 44 comprises a draw latch with locking means 54. The draw latch of latching and locking means 44 contains a base plate 42 attached to the bottom of lower bracket means 18. Outer plate 36 containing protrusion 39, near the inner top portion thereof is attached to base plate 42 by hinge 38. Outer plate 36 is an L-shaped structure attached to base plate 42 by hinge 38 on one side and constructed to engage the other side of base plate 42 when in a closed position. Latching arm 36 is attached to lever 26 by metallic pin 34 and said lever 26 is attached to base plate 42 by metallic pins 32, e.g. two pins. Latching arm 36, containing latching head 28 which has a serrated surface, engages the serrated surface of lower retaining plate 58, securing panel 6 in the desired position.

Outer plate 36 of latching and locking means 44 is rotated along line 56 around hinge 38 to engage the outer portion of base plate 42. Lock 54 passes through holes 40 and 41 to lock, latching and locking means 44.

Obviously, many modifications and variations of the invention, as hereinbefore set forth, may be made without departing from the spirit and scope thereof, and therefore, only such limitations should be imposed as are indicated in the appended claims.

I claim:

1. Rapid mount advertising panels for motor vehicles that comprise a plurality of panels having a first and last panel, each of said panels containing a top portion, a bottom portion, a center portion, a back side, a front, a central retaining plate and cavity located on the back side of each of said panels, wherein said central cavity has a top and a bottom; at least one bottom retaining plate and bottom cavities located on the front and near the bottom portion of each of said panels, wherein each of said bottom cavities has a top and a bottom; air foil means attached to the front and back side respectively of the first and last panels, upper bracket means for receiving and securing the top portion of each of said panels; central bracket means for engaging and securing the center portion of each of said panels; lower bracket means for receiving and securing the bottom portion of each of said panels; and latching and locking means for latching the bottom portion of each of said panels and locking means for locking said bottom latching means.

2. The rapid mount advertising panels in accordance with claim 1, wherein the plurality of panels comprise from 2 to 16 panels.

3. The rapid mount advertising panels according to claim 1, wherein individual panels are from 2 feet to 6 feet, wide and from 6 feet to 10 feet tall.

4. The rapid mount advertising panels of claim 1, wherein the central retaining plate comprises a downward directed overhanging lip which extends from the top of said central cavity in an downward direction.

5. The rapid mount advertising panels of claim 1, wherein each of the bottom retaining plates comprise an upwardly directed overhanging lip which extends from the bottom of said bottom cavities in an upward direction, said overhanging lip having a serrated surface.

6. The rapid mount advertising panels as described in claim 1, wherein the upper bracket means comprises an elongated inverted G shaped channel containing an outward, downwardly directed lip.

7. The rapid mount advertising panels as disclosed in claim 6, wherein the outer, downwardly directed lip contains a padded attachment.

8. The rapid mount advertising panels according to claim 1, wherein the air foil means comprises an angled non-porous sheet-like material that is attached to the front and back-side respectively of the first and last panels.

9. The rapid mount advertising panels in accordance with claim 1, wherein the central bracket means contains an elongated, C-shaped brace containing a downwardly directed lip and a plurality of angled, upwardly directed latches attached to a bottom of said brace.

10. The rapid mount advertising panels of claim 1, wherein the lower bracket means comprises an elongated inverted, G-shaped channel containing an inner downwardly directed lip and an outer, upwardly directed lip.

11. The rapid mount advertising panels described in claim 1, wherein the latching means contains at least one draw latch attached to the bottom of the lower bracket means.

12. The rapid mount advertising panels of claim 11 wherein the draw latches comprise a lever member pivotably connected to a base plate, a latching arm pivotably connected to the lever member; said latching arm containing an end portion having a serrated surface with an overhanging lip for grabbing and securing the lower bracket means.

13. The rapid mount advertising panels of claim 12, wherein the draw latches contain an outer plate that is hingeably attached to the base plate, each of said outer plate and base plate having an opening for receiving a lock when the outer plate is rotated in a closed position.

14. The rapid mount advertising panels described in claim 1, wherein the upper bracket means, central bracket means and lower bracket means are in a spacial relationship to each other and are adapted to be attached to a truck trailer.

15. Rapid mount advertising panels for attaching to flat surfaces that comprise from 2 to 12 panels wherein each of said panels is from 2 feet to 4 feet wide and from 6 feet to 8 feet tall, each of said panels containing a central retaining plate and cavity located on a back side of each of said panels; 2 bottom retaining plates and cavities located on a front and near a bottom portion of each of said panels; a top, elongated, inverted G-shaped channel member in cross section for receiving and securing a top portion of each of said panels; a central elongated, C-shaped brace in cross-section containing a plurality of latches for engaging and securing a center portion of each of said panels; a bottom, elongated, inverted, G-shaped channel in cross-section for receiving and securing the bottom portion of each of said panels; and two draw latches attached to a bottom of the bottom channel.

16. The rapid mount advertising panels in accordance with claim 15, wherein a flat surface is adapted to be a side of a truck trailer.

17. The rapid mount advertising panels of claim 15, wherein a flat surface is a side of a railroad car.

18. The rapid mount advertising panels as described in claim 15, wherein a flat surface is a billboard.

19. The rapid mount advertising panels according to claim 15, wherein a flat surface is adapted to be a side of a building.

20. The rapid mount advertising panels of claim 15, wherein a flat surface is a transportable unit pulled behind a motor vehicle.

* * * * *